US007179141B1

(12) United States Patent
McMullen

(10) Patent No.: US 7,179,141 B1
(45) Date of Patent: Feb. 20, 2007

(54) PERSONAL AIR PROPULSION DEVICE

(76) Inventor: John D. McMullen, P.O. Box 1280, Stroudsburg, PA (US) 18360

( * ) Notice: Subject to any disclaimer, the term of this patent is extended or adjusted under 35 U.S.C. 154(b) by 0 days.

(21) Appl. No.: 11/113,647

(22) Filed: Apr. 26, 2005

(51) Int. Cl.
*B63H 7/00* (2006.01)
*A63C 5/08* (2006.01)

(52) U.S. Cl. ..... 440/37; 180/180

(58) Field of Classification Search ..... 114/55.5; 440/37; 180/180
See application file for complete search history.

(56) References Cited

U.S. PATENT DOCUMENTS 1,792,031 A * 2/1931 Price ..... 440/37
2,509,603 A 5/1950 Marin
3,570,785 A 3/1971 Croft
3,576,376 A 4/1971 Steeg
5,222,569 A * 6/1993 Martel ..... 180/180
6,305,048 B1 * 10/2001 Salisian ..... 15/326

* cited by examiner

*Primary Examiner*—Jesús D. Sotelo
(74) *Attorney, Agent, or Firm*—Crossley Patent Law; Mark A. Crossley

(57) ABSTRACT

A backpack with backpack frame and adjustable shoulder harness removably fitting a person, the backpack further comprising an internal combustion engine with a pulley system connecting the engine to a propeller axle with propeller, a propeller surround with air intake and air outlet whereby the propeller propels a person upon a given surface. Handles comprise controls for throttle, kill switch, and lights. Handles are a part of the backpack frame or of ski poles. A pendulum emergency stop device kills the engine if the person falls.

4 Claims, 10 Drawing Sheets

PERSONAL AIR PROPULSION DEVICE

BACKGROUND OF THE INVENTION

A personal air propulsion device of sophisticated design is needed to power an individual over a chosen surface. The surface might be ice, snow, water, land, pavement, or any surface chosen. The device should provide lightweight air propulsion from an internal combustion engine powering a fan. The fan drive should be stepped up from the speed of the engine's crankshaft such that increased fan speed provides greater thrust than would direct drive. Air should be guided into the device in a laminar fashion. Air should be expelled from the device in a way that further increases thrust. The fan drive of the device should be housed to avoid potential injury and to provide greater thrust. Air inlets and outlets should be screened to prevent the intrusion of foreign objects. The device should offer lighting for night use, with battery backup for the lights. The device should offer hand controls.

Further, the device should offer safety features whereby it can either be manually turned off in an instant or turned off automatically should a user fall. The present invention fulfills these needs.

FIELD OF THE INVENTION

The invention relates to propulsion devices, and more specifically to a personal air propulsion device for use by an individual in snow skiing, skating, bicycling, or the like.

SUMMARY OF THE INVENTION

The general purpose of the personal air propulsion device, described subsequently in greater detail, is to provide a personal air propulsion device with many novel features that result in a personal air propulsion device which is not anticipated, rendered obvious, suggested, or even implied by prior art, either alone or in combination thereof.

To accomplish this, the improved personal air propulsion device comprises a backpack frame, the exemplary frame of plastic or aluminum. The front of the frame is padded for the comfortable receipt of a user's back. A padded shoulder harness with a single buckle is attached to the front of the frame.

In one example, the invention offers arm rests that extend forward from the frame and are disposed below a user's arms. Armrests are adjustable to fit a wide range of user sizes. Handles are disposed toward the forward and upward end of each armrest. Controls for motor on/off and motor speed are fitted within one handle. A light switch is disposed within the opposite handle. Optional lights are mounted to either side and on top of the propeller drive housing. Lights are mounted atop light stalks. Lights provide for forward facing headlights and rearward facing red tail lights.

The propeller drive housing is mounted to the back of the back pack frame. The housing contains a drive pulley mounted to the motor output, a slave pulley, and the belt that rotatably connects the two. The drive belt partially encircles the drive pulley and extends downward to partially encircle the slave pulley. The slave pulley is removably attached to a propeller axle. In one example, the pulleys are sized to drive the propeller axle at twice the speed of the engine's crankshaft. Pulley sizes are varied in other examples. The propeller drive housing is accessible through the front of the backpack frame for adjustment of the pulley system. The propeller axle is supported at the backpack frame by an axle front bearing. Extending back into the propeller surround, the propeller axle is supported by a propeller axle stabilizer bearing mounted within the center of the propeller stabilizer. The propeller stabilizer is mounted within the propeller surround and thereby provides stability for the propeller axle and the propeller.

The propeller is mounted at the rear of the axle. One example of the invention uses a two-blade propeller. In yet a further example, the fan is of typical turbine fan design. Air intake shrouds are to the front of and on either side of the propeller surround. Intake shrouds further comprise a protective screening to prevent clothing and other foreign objects from being drawn into the propeller. Air is drawn into the intake shrouds via air intake cones which provide for greater and more laminar air intake. Air is pulled through the propeller surround by the propeller and exits via the air outlet cone. The air outlet cone is provided for greater directional air flow and thrust.

The gasoline engine is mounted above the propeller surround. One example utilizes a 2-cycle gasoline engine. Alloys such as aluminum are exemplified, to insure light weight of the invention. The fuel tank is of non-leak design. The drive belt is a V-belt in one example. A further example of the personal air propulsion device utilizes a toothed belt.

In yet a further example, the user handles are affixed atop ski poles. Controls for the motor and lights remain in the handles. Flexible wires connect the handles to the back pack motor and lights. In an additional example, the motor control is via unplugable wire such that excessive movement of the handle away from the backpack affects motor kill. In this way, accidents affect the kill switch to the motor. In yet a further example, the motor and light controls are sent and received via airwave signal to the back pack from the handles.

A further optional safety feature of the personal air propulsion device utilizes a pendulum emergency stop device that is housed in a small encasement mounted against the fuel tank. Other examples mount the pendulum device in various locations. The location is not critical. The orientation of the pendulum requires that the pivot be uppermost oriented, at the 12:00 position. If a user falls, a pendulum needle makes contact with a right or left contact post within the housing. Pendulum contact stops the engine.

The personal air propulsion device utilizes aluminum, plastics, composites, and a combination thereof to best achieve light weight and inexpensive production.

Thus has been broadly outlined the more important features of the personal air propulsion device so that the detailed description thereof that follows may be better understood and in order that the present contribution to the art may be better appreciated.

Numerous objects, features and advantages of the personal air propulsion device will be readily apparent to those of ordinary skill in the art upon reading the following detailed description of presently preferred, but nonetheless illustrative, embodiments of the personal air propulsion device when taken in conjunction with the accompanying drawings.

In this respect, before explaining the current embodiments of the personal air propulsion device in detail, it is to be understood that the invention is not limited in its application to the details of construction and arrangements of the components set forth in the following description or illustration. The invention is capable of other embodiments and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the personal air propulsion device. It is therefore important that the claims be regarded as including such equivalent constructions insofar as they do not depart from the spirit and scope of the present invention.

Objects of the personal air propulsion device, along with various novel features that characterize the invention are particularly pointed out in the claims forming a part of this disclosure. For better understanding of the personal air propulsion device, its operating advantages and specific objects attained by its uses, refer to the accompanying drawings and description.

DETAILED DESCRIPTION OF THE PREFERRED EMBODIMENT

With reference now to the drawings, and in particular FIGS. 1 through 10 thereof, the preferred embodiment of the personal air propulsion device employing the principles and concepts of the present invention and generally designated by the reference number 10 will be described.

Figure 1:
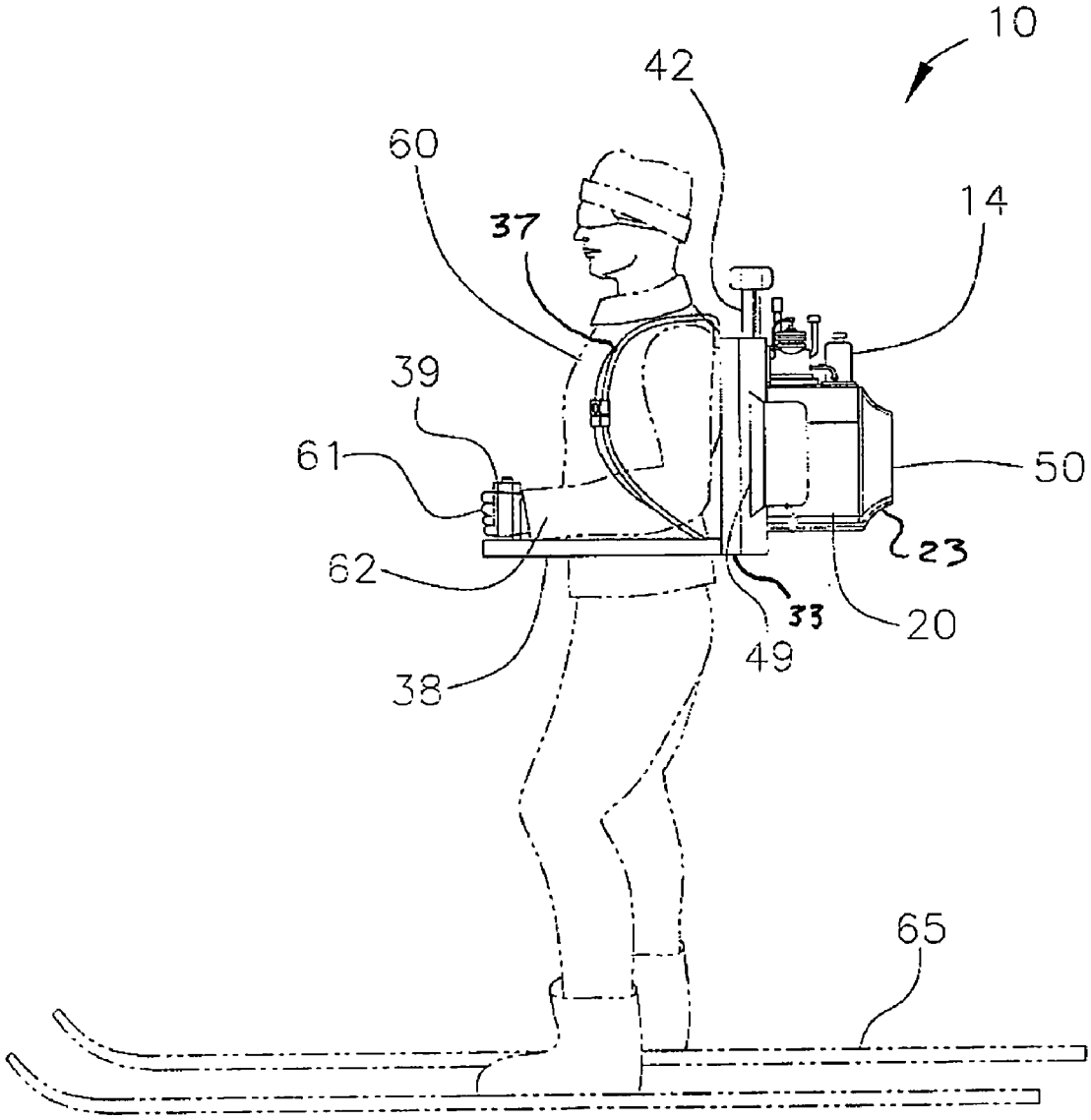
FIG. 1 is a side elevation view of the personal air propulsion device on a user, the device equipped with arm rests with controls.

Referring to FIG. 1, the invention 10 is worn by a user 60. User's arm 62 rest upon arm rest 38. User's hand 61 grasps handle 39. Arm rest 38 extends forward from vertical backpack frame 33. Shoulder harness 37 adjustably secures backpack frame 33 to user 60. Light stalk 42 extends upwardly from the top of frame 33. Propeller surround 20 extends backward from backpack frame 33. Air in 49 is proximal to user 60. Air out 50 exits air outlet cone 23. User 60 glides atop skis 65.

Figure 2:
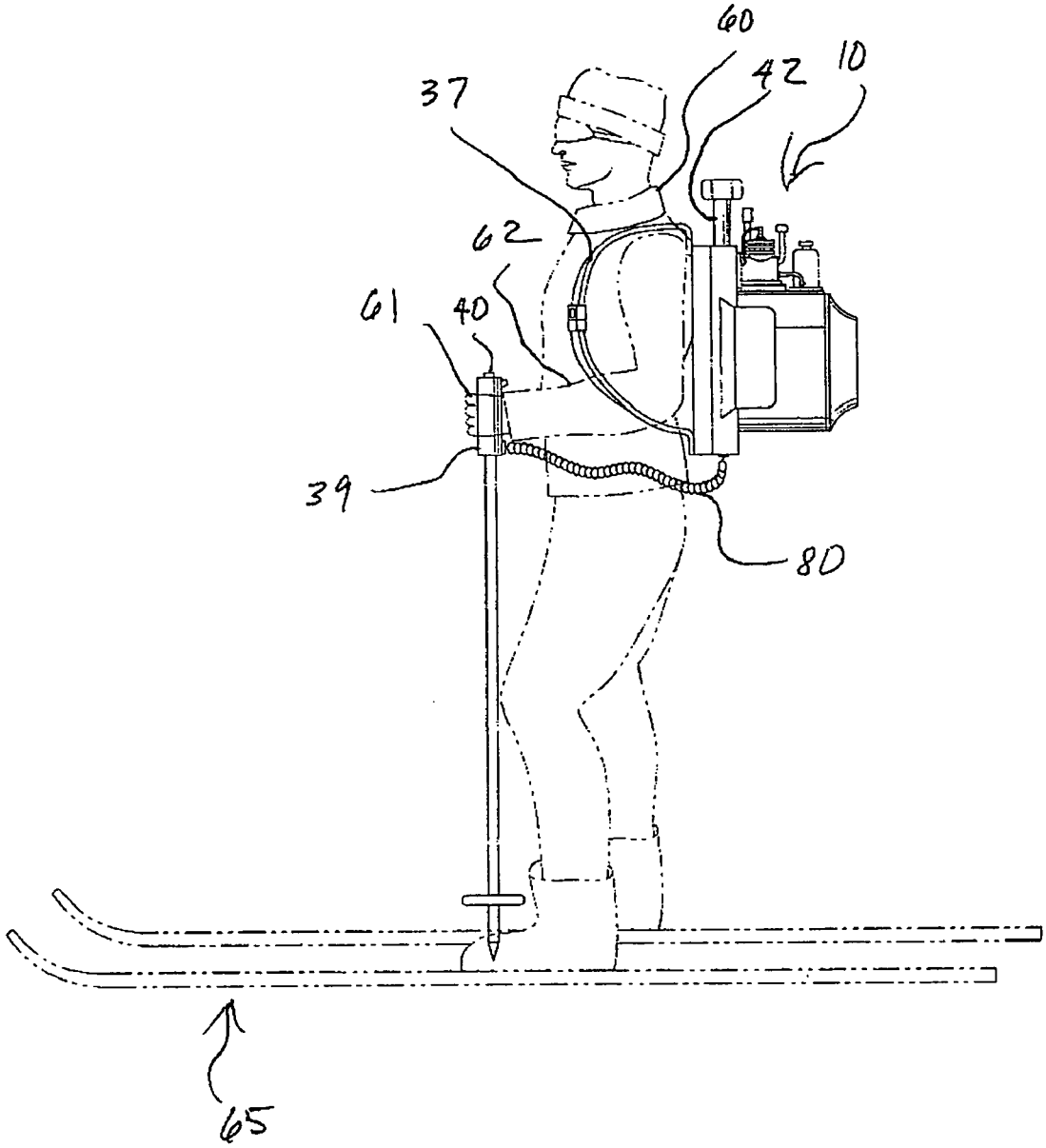
FIG. 2 is a side elevation view of the personal air propulsion device, the device equipped with ski poles with controls.

Referring to FIG. 2, user 60 grasps handle 39. Handle 39 further comprises light switch 40 atop handle 39. Wire 80 connects light switch 40 to light stalk 42.

Figure 3:
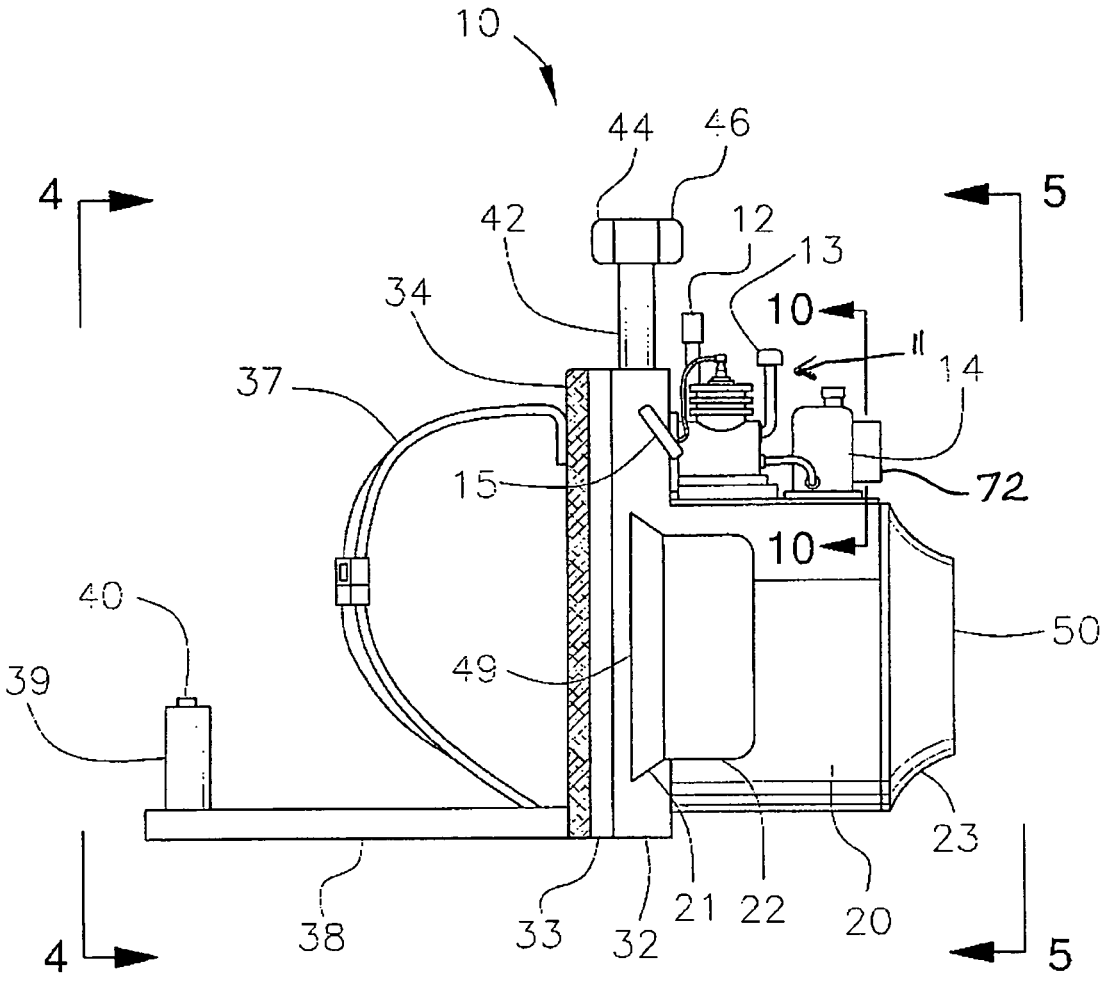
FIG. 3 is a side elevation view of the personal air propulsion device of FIG. 1.

Referring to FIG. 3, invention 10 is comprised of vertical backpack frame 33. Backpack frame 33 is covered in front by padding 34. Arm rest 38 extends forward from the lower part of backpack frame 33. Handle 39 projects upwardly from the forward end of the top of arm rest 38. Handle 39 is topped by light switch 40. Propeller drive housing 32 extends backwardly from backpack frame 33. Propeller surround 20 extends back from propeller drive housing 32. Air intake shroud 22 communicates with propeller surround 20. Air intake shroud 22 is laterally outward from propeller surround 20. Air intake shroud 22 is fronted by air intake cone 21 for enhancing laminar airflow of air in 49 into invention 10. Air leaves propeller surround 20 via air outlet cone 23 as air out 50. Engine 11 is atop propeller surround 20. Engine 11 is mounted to the upper rear of propeller drive housing 32. Pull start 15 provides for starting engine 11. Engine intake 12 is atop engine 11. Exhaust 13 exits upwardly from the rear of engine 11. Fuel tank 14 supplies engine 11. Light stalk 42 extends upwardly from propeller drive housing 32. Headlight lens 44 faces forward. Taillight lens 46 faces backward.

Figure 4:
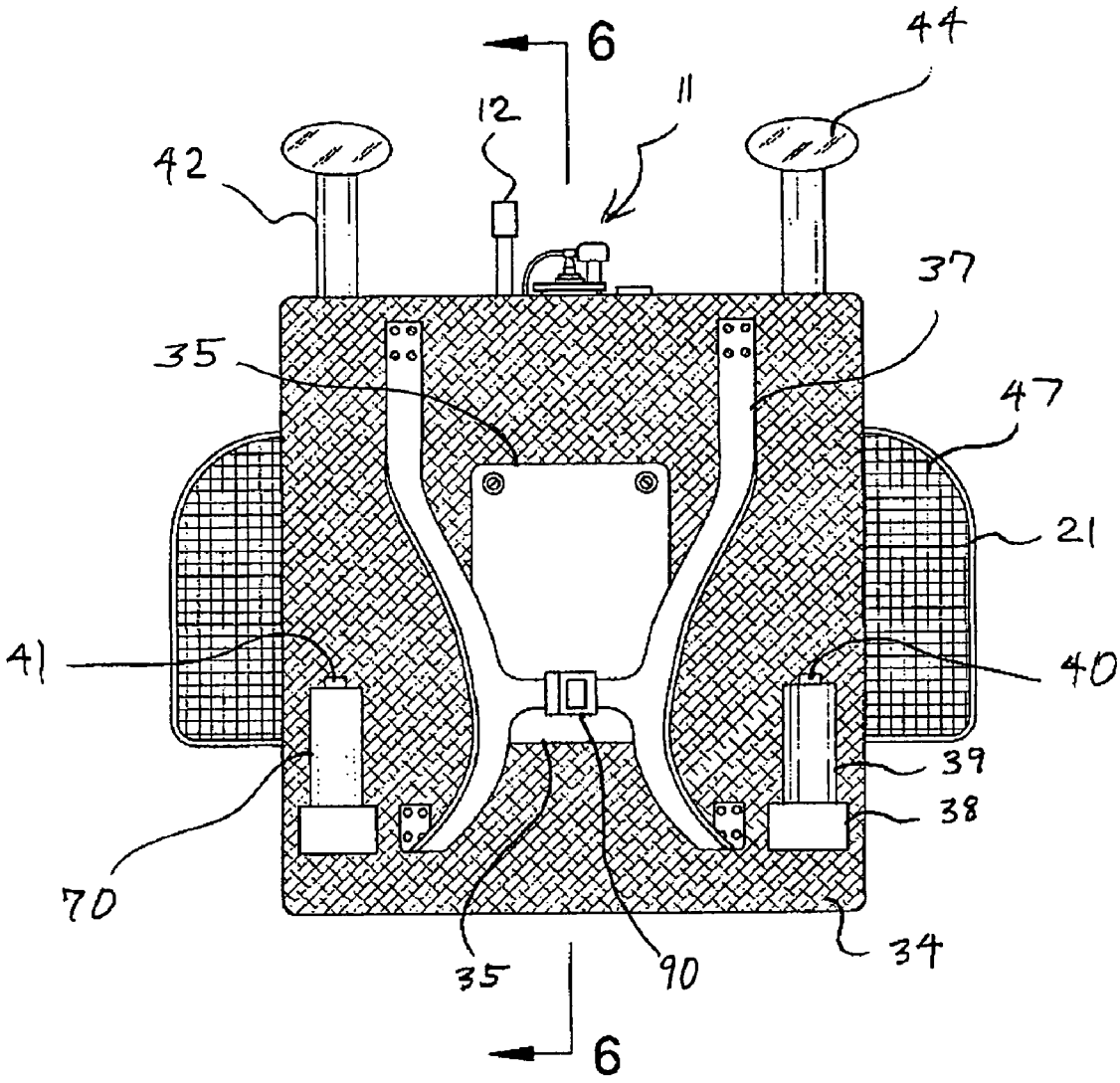
FIG. 4 is a front elevation view of the invention of FIG. 3 taken along the line 4—4.
Figure 7:
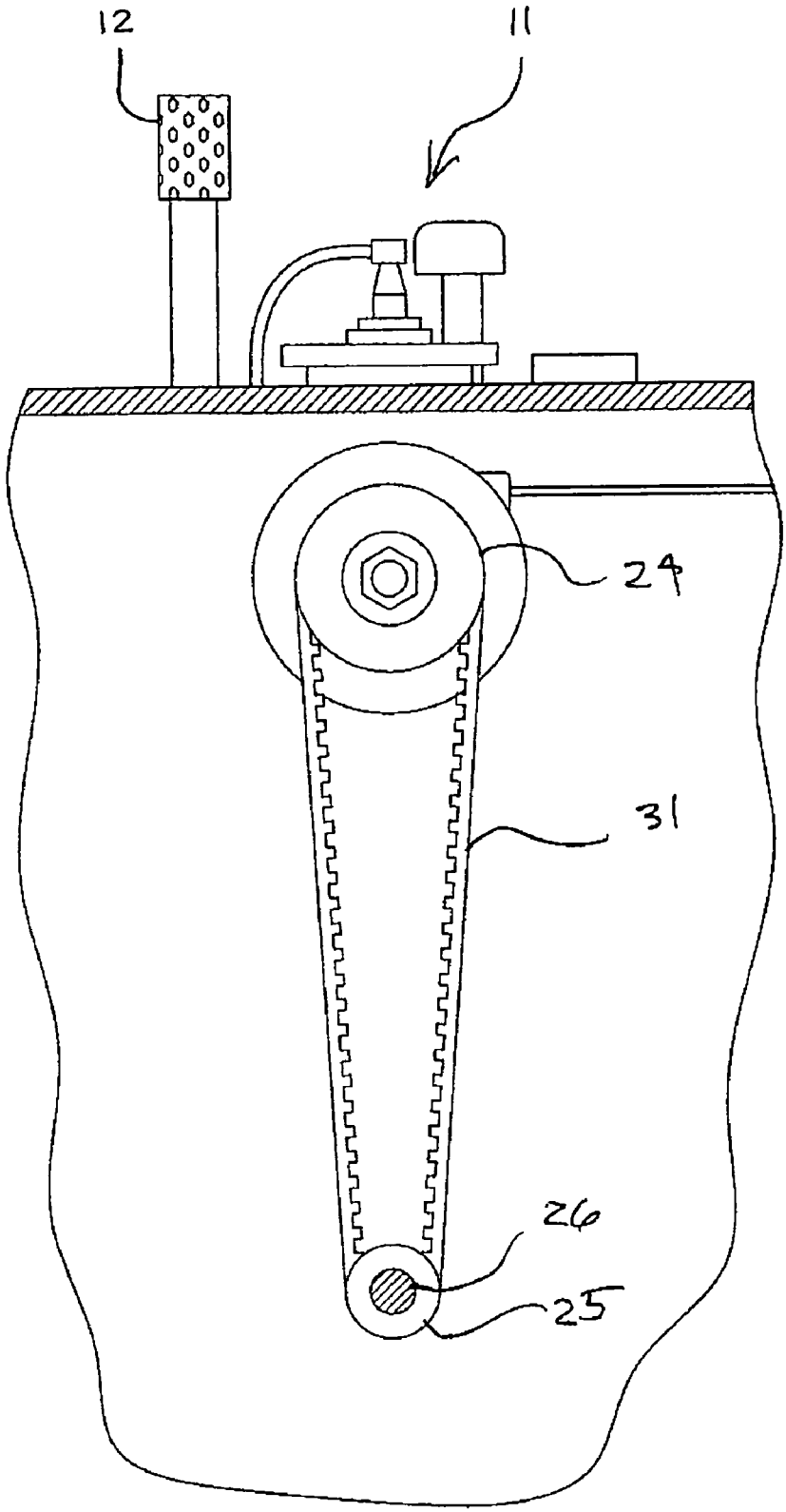
FIG. 7 is a front cross sectional view of the pulley system components of the invention in FIG. 6 taken along the line 7—7.

Referring to FIG. 4, the front of the invention 10 comprises padding 34 for cushioning a user 60 (FIGS. 1 and 2). Shoulder harness 37 adjusts to a user via a single buckle 90. Access door 35 provides for access to the pulley system (FIG. 7). Light stalks 42 extend upwardly from the invention 10 to reveal headlight lenses 44. Arm rests 38 are forwardly topped by handles 39. Handle 39 on the user's right side further comprises throttle 70. Kill button 41 is atop handle 39 of the right side of the invention 10. Light switch 40 is atop handle 39 on the left side of invention 10. Air intake cones 21 are revealed laterally outside the boundaries of the backpack. Air intake screens 47 prevent the intake of undesired objects (not shown) into invention 10. The top of engine 11 is visible about the backpack padding 34.

Figure 5:
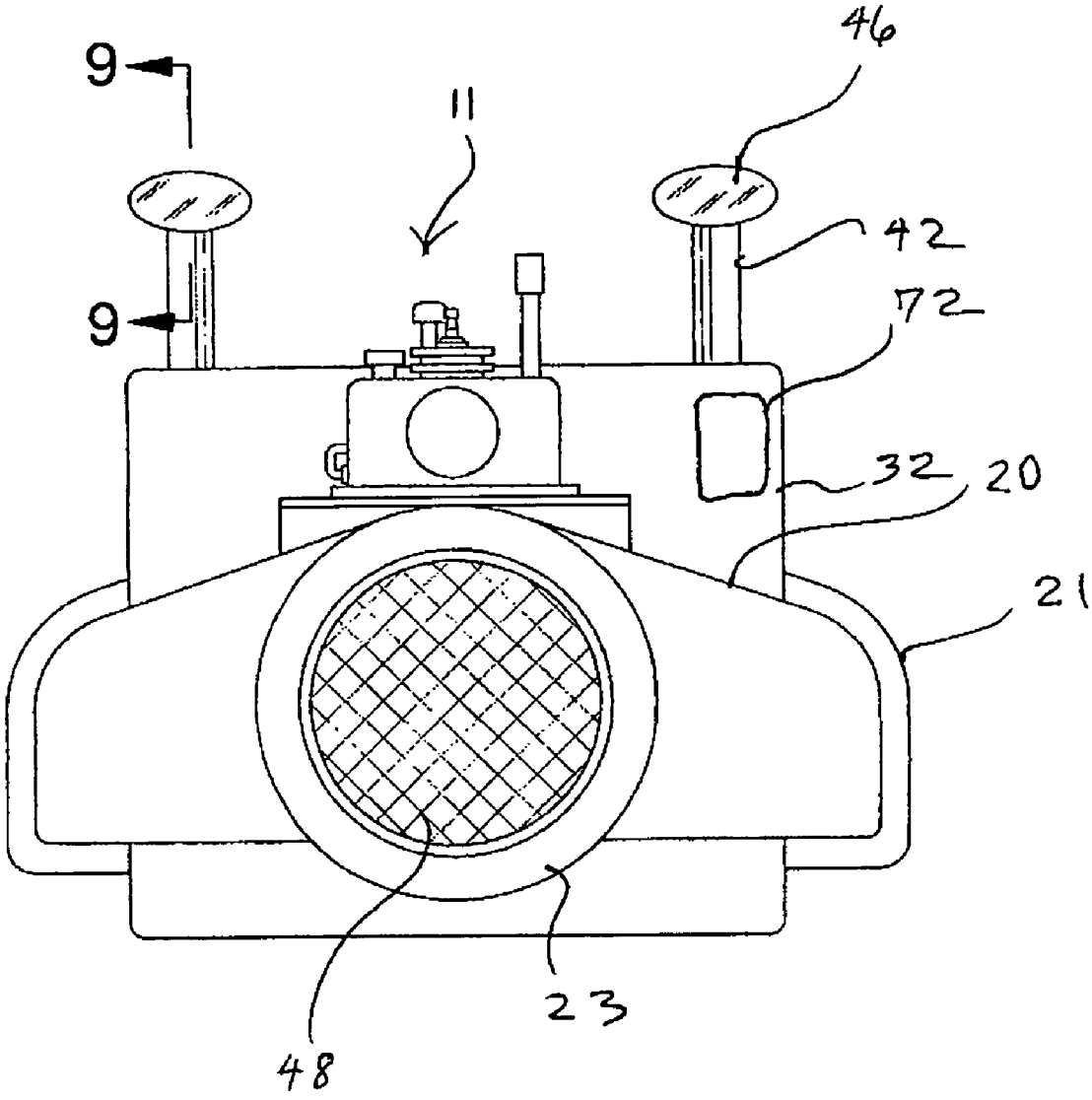
FIG. 5 is a rear elevation view of the invention in FIG. 3 taken along the line 5—5.

Referring to FIG. 5, the back view of invention 10 comprises rearmost air outlet cone 23. Air outlet screen 48 is visible within cone 23. Air outlet cone 23 exits rearward from propeller surround 20. Air intake cones 21 flare outwardly and provide for enhanced laminar entry of air.

Figure 6:
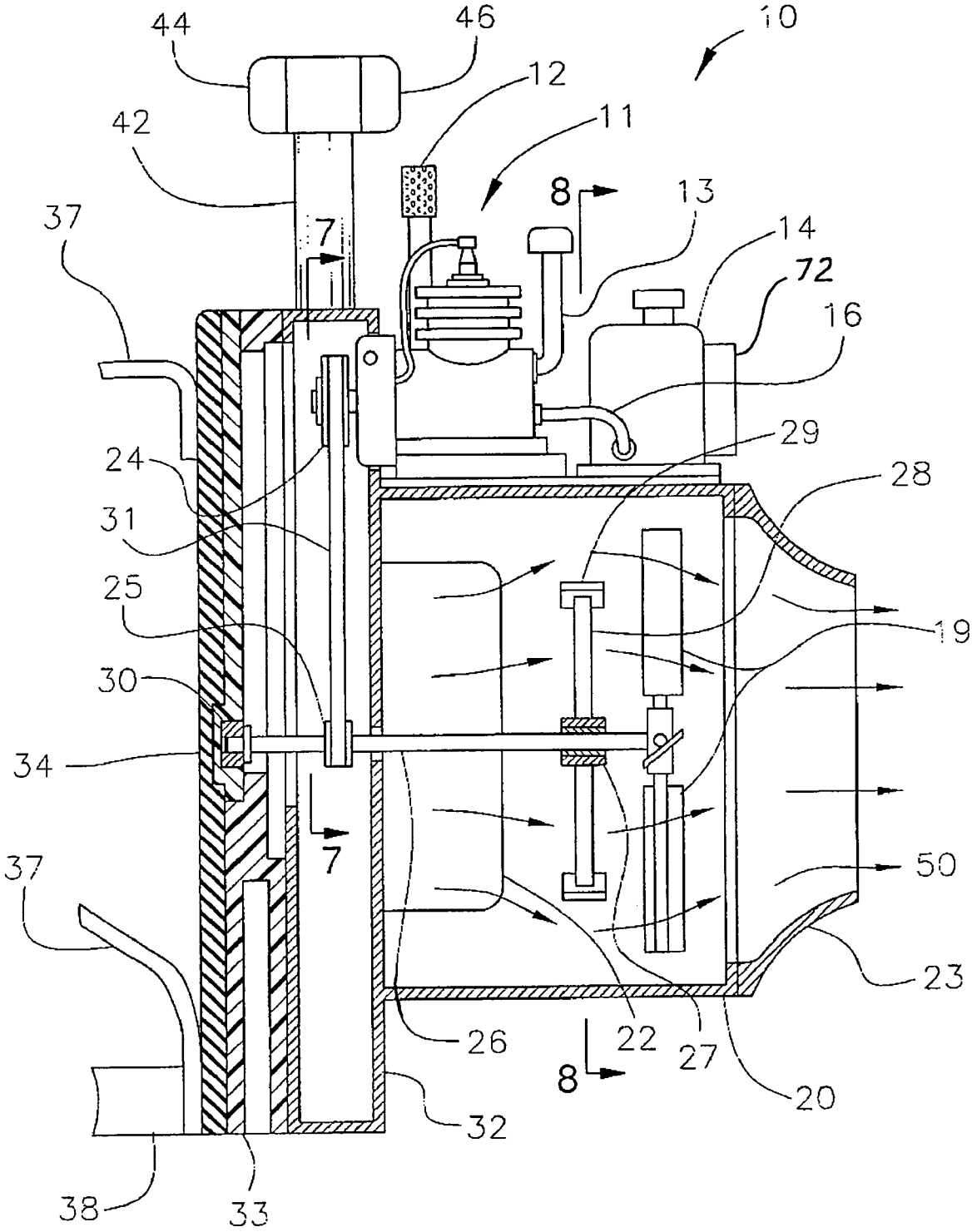
FIG. 6 is a cross sectional view of the invention of FIG. 4 taken along the line 6—6.

Referring to FIG. 6, backpack frame 33 is rearwardly attached with propeller drive housing 32. Backpack frame 33 centrally contains axle front bearing 30. Bearing 30 forwardly and rotationally contains propeller axle 26. Propeller axle 26 is rearwardly rotationally contained within propeller axle stabilizer bearing 27. Propeller axle stabilizer bearing 27 is housed within the center of propeller stabilizer 28. Propeller stabilizer 28 is fixed in a plurality of spots about the interior of propeller surround 20 at propeller stabilizer mounts 29. Propeller 19 spins in the vertical plane to the rear of propeller stabilizer 28. Propeller 19 is fixed to propeller axle 26. Engine 11 is mounted to propeller drive housing 32. The drive pulley 24 is horizontally forward from engine 11. The drive pulley 24 rotates in the vertical plane. Propeller axle 26 is affixed with slave pulley 25. Slave pulley 25 is directly aligned with and below drive pulley 24. Drive belt 31 drives slave pulley 25 from rotation of drive pulley 24. Fuel line 16 supplies engine 11 from fuel tank 14.

Referring to FIG. 7, toothed drive belt 31 is driven by drive pulley 24 to drive slave pulley 25 and hence propeller axle 26.

Figure 8:
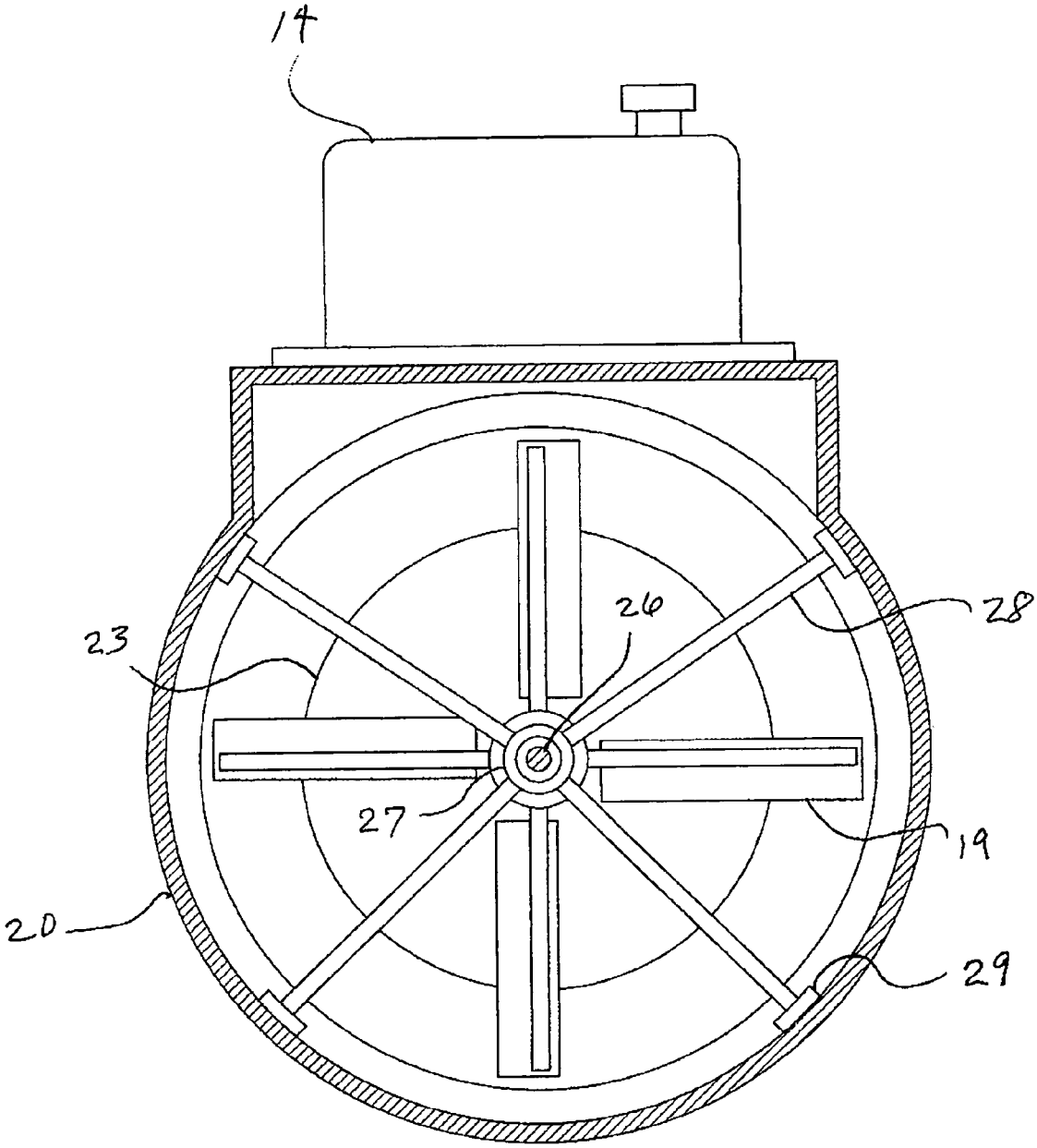
FIG. 8 is a rear cross sectional view of the propeller and propeller stabilizer of the invention of FIG. 6 taken along the line 8—8.

Referring to FIG. 8, propeller axle 26 is freely rotationally housed within propeller axle stabilizer bearing 27. Propeller axle stabilizer bearing 27 is supported by propeller stabilizer 28.

Figure 9:
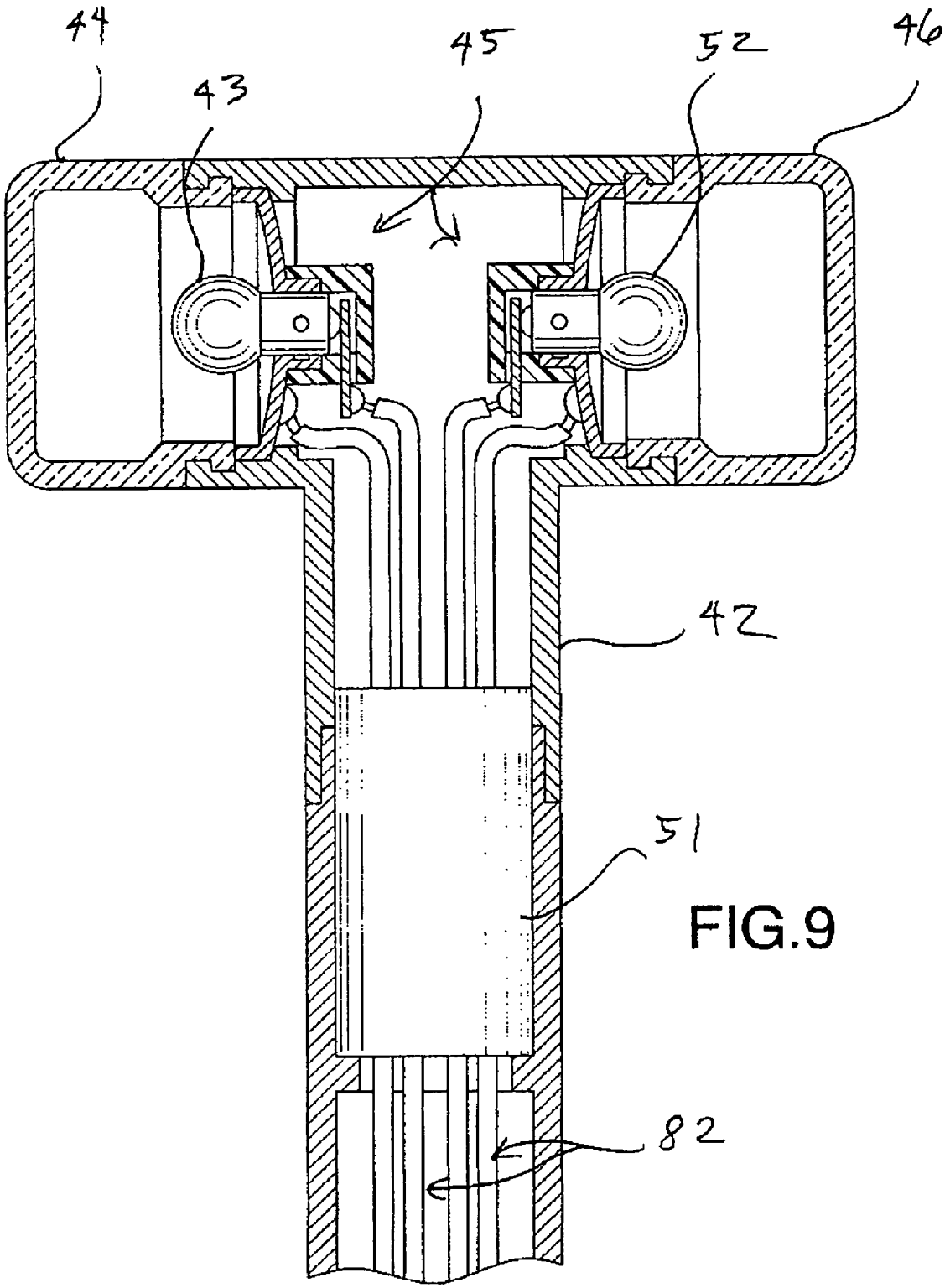
FIG. 9 is a lateral cross sectional view of the light stalk and related components of the invention in FIG. 5 taken along the line 9—9.

Referring to FIG. 9, the light stalk 42 supports and houses the light assembly 45. The light assembly 45 contains headlight 43 and taillight 52. The clear headlight lens 44 protects the headlight 43. The red taillight lens 46 protects taillight 52. Battery 51 provides backup power to lighting mechanism 45. The powering wires 82 are powered by engine 11.

Figure 10:
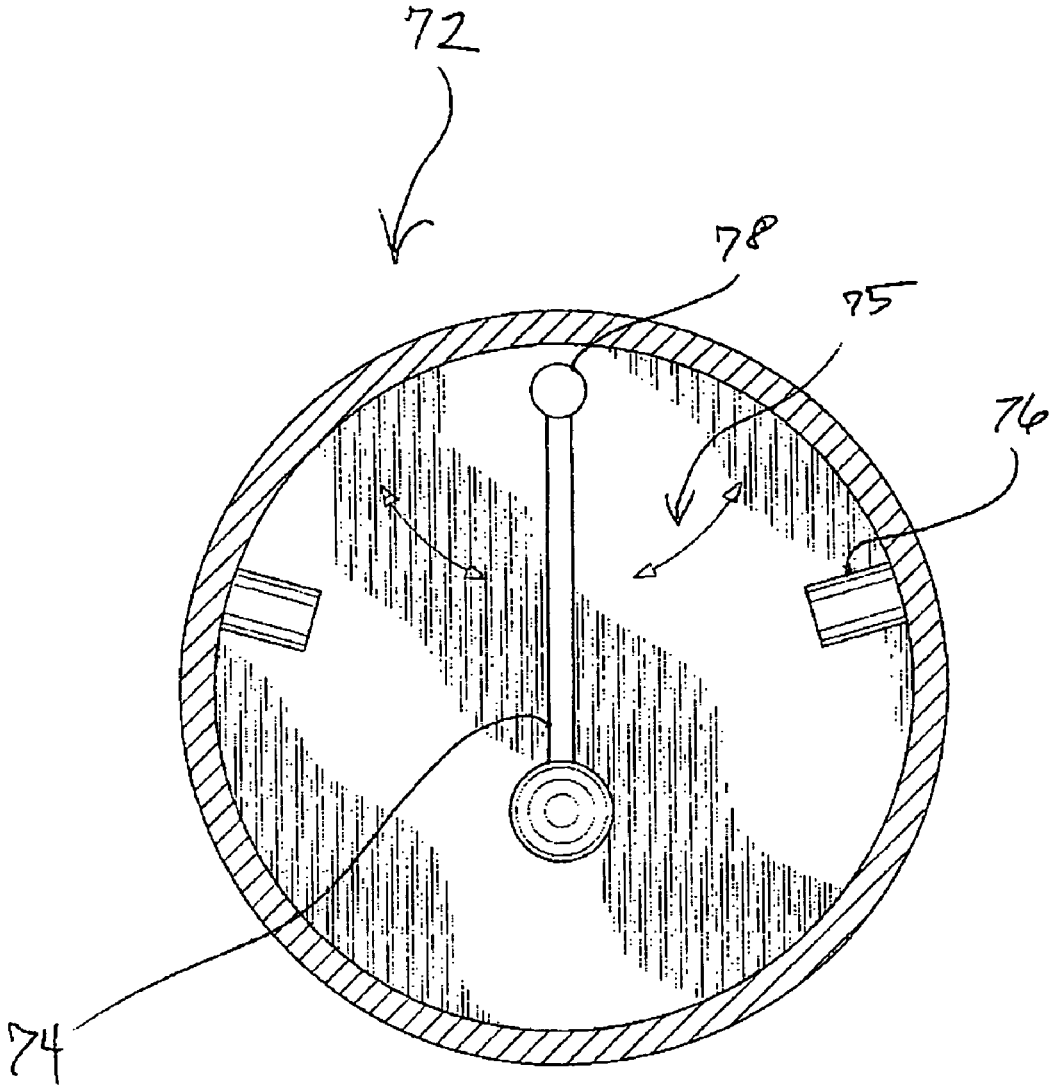
FIG. 10 is a rear cross sectional view of the pendulum mechanism of the invention in FIG. 3 taken along the line 10—10.

Referring to FIG. 10, the pendulum mechanism 72 provides for the emergency stop device of invention 10. The pendulum mechanism 72 is mounted toward the rear of the invention 10 against the fuel tank 14. The pendulum mechanism 72 internal components are contained as shown in FIG. 10. Pivot 78 is within the upper portion of pendulum mechanism 72. Contacts 76 are positioned to either side of pendulum 74. The pendulum 74 swings freely from the pivot 78. As noted from arc arrow 75, excessive lateral motion of pendulum 74 will meet either contact 76, depending upon the direction of lean of the invention 10. Contact of pendulum 74 to contacts 76 causes the emergency stop mechanism to kill the engine 11.

With respect to the above description then, it is to be realized that the optimum dimensional relationships for the parts of the personal air propulsion device, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A personal air propulsion device for a person, the device comprising:

a backpack with backpack frame;

an adjustable shoulder harness affixed to the backpack frame, the shoulder harness removably fitting the person;

an internal combustion engine with fuel supply and pull starter mounted to the backpack frame;

a pulley system comprising a toothed belt and toothed pulleys, the pulley system connecting the engine to a propeller axle with propeller, whereby the propeller axle turns at twice the revolutions per minute of the engine;

adjustment means for the pulley system;

an access door centrally disposed in the backpack frame, the access door for accessing the pulley system;

an axle front bearing for the propeller axle, the axle front bearing disposed within the backpack frame;

a propeller surround surrounding the propeller;

a propeller axle stabilizer bearing disposed within a propeller stabilizer, the stabilizer fixedly disposed within the propeller surround;

two spaced apart air intake shrouds, each shroud disposed on an opposite side of the backpack frame, each air intake shroud supplying air to the propeller surround;

an air intake cone affixed to each shroud, the intake cone enhancing laminar flow of air into the shroud;

an air intake screen affixed to each cone;

an air outlet cone supplied with air by the propeller surround, the outlet cone beginning with a diameter equal to the propeller surround and gradually decreasing to a smaller diameter;

two spaced apart light stalks mounted proximally to a top of the backpack frame and projecting upwardly;

a headlight on each stalk;

a taillight on each stalk;

a backup battery power within each stalk;

powering wires from the engine to the light stalks;

a spaced apart pair of armrests projecting forward from the backpack frame;

a handle on each armrest;

a hand operated throttle and a kill switch for the engine on one handle;

a light switch on the opposite handle;

communicating means between the throttle and kill switch and the engine;

communicating wires between the light switch and lights;

a pendulum emergency stop device mounted to the backpack frame, whereby a fall by the person kills the engine.

2. A personal air propulsion device for a person, the device comprising:

a backpack with backpack frame;

an adjustable shoulder harness affixed to the backpack frame, the shoulder harness removably fitting the person;

an internal combustion engine with fuel supply and pull starter mounted to the backpack frame;

a pulley system comprising a toothed belt and toothed pulleys, the pulley system connecting the engine to a propeller axle with propeller, whereby the propeller axle turns at twice the revolutions per minute of the engine;

adjustment means for the pulley system;

an access door centrally disposed in the backpack frame, the access door for accessing the pulley system;

an axle front bearing for the propeller axle, the axle front bearing disposed within the backpack frame;

a propeller surround surrounding the propeller;

a propeller axle stabilizer bearing disposed within a propeller stabilizer, the stabilizer fixedly disposed within the propeller surround;

two spaced apart air intake shrouds, each shroud disposed on an opposite side of the backpack frame, each air intake shroud supplying air to the propeller surround;

an air intake cone affixed to each shroud, the intake cone enhancing laminar flow of air into the shroud;

an air intake screen affixed to each cone;

an air outlet cone supplied with air by the propeller surround, the outlet cone beginning with a diameter equal to the propeller surround and gradually decreasing to a smaller diameter;

two spaced apart light stalks mounted proximally to a top of the backpack frame and projecting upwardly;

a headlight on each stalk;

a taillight on each stalk;

a backup battery power within each stalk;

powering wires from the engine to the light stalks;

two ski poles with handles;

a hand operated throttle and an engine kill switch on one handle;

a light switch on the other handle;

communicating means between the throttle and the engine;

communicating wires between the light switch and lights;

a pendulum emergency stop device mounted to the backpack frame, whereby a fall by the person kills the engine.

3. The invention in claim 1 wherein the internal combustion engine is a two-cycle engine.

4. The invention in claim 2 wherein the internal combustion engine is a two-cycle engine.

* * * * *